US010633955B2

(12) United States Patent
Hoelscher et al.

(10) Patent No.: US 10,633,955 B2
(45) Date of Patent: Apr. 28, 2020

(54) NANO-PARTICLE REINFORCED WELL SCREEN

(75) Inventors: Christopher C. Hoelscher, Arlington, TX (US); Aaron J. Bonner, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 805 days.

(21) Appl. No.: 14/370,461

(22) PCT Filed: Mar. 22, 2012

(86) PCT No.: PCT/US2012/030182

§ 371 (c)(1),
(2), (4) Date: Jul. 2, 2014

(87) PCT Pub. No.: WO2013/141867

PCT Pub. Date: Sep. 26, 2013

(65) Prior Publication Data

US 2015/0129199 A1 May 14, 2015

(51) Int. Cl.
*E21B 43/08* (2006.01)
*E03B 3/20* (2006.01)

(52) U.S. Cl.
CPC ..... *E21B 43/082* (2013.01); *E03B 3/20* (2013.01); *E21B 43/08* (2013.01)

(58) Field of Classification Search
CPC ..... E21B 43/08; E21B 43/082
See application file for complete search history.

(56) References Cited

U.S. PATENT DOCUMENTS 1,787,634 A * 1/1931 Laubner ..... E21B 43/088 166/235
3,216,497 A 11/1965 Howard et al.
4,202,411 A 5/1980 Sharp et al.
4,821,800 A 4/1989 Scott et al.
5,108,813 A * 4/1992 Noda ..... C04B 41/009 428/141
5,113,941 A 5/1992 Donovan
5,115,864 A 5/1992 Gaidry et al.
5,150,753 A 9/1992 Gaidry et al.
5,165,476 A 11/1992 Jones
5,232,048 A * 8/1993 Whitebay ..... E21B 43/082 166/228
5,500,174 A * 3/1996 Scott ..... B01D 29/111 264/112
5,855,242 A 1/1999 Johnson
5,881,812 A 3/1999 Malbrel et al.
(Continued)

FOREIGN PATENT DOCUMENTS

EP 0819831 A1 1/1998

OTHER PUBLICATIONS

International Search report with Written Opinion dated Oct. 25, 2012 for PCT Patent Application No. PCT/US12/024897, 17 pages.
(Continued)

*Primary Examiner* — Tara E Schimpf
(74) *Attorney, Agent, or Firm* — Locke Lord LLP

(57) ABSTRACT

A well screen for use in a subterranean well can include a filter with a nano-particle reinforcement. A method of constructing a well screen can include treating a filter with a nano-particle reinforcement.

17 Claims, 3 Drawing Sheets

(56) References Cited

U.S. PATENT DOCUMENTS

| | | | | |
|---|---|---|---|---|
| 5,893,416 | A * | 4/1999 | Read | E21B 37/06 166/228 |
| 6,390,195 | B1 | 5/2002 | Nguyen et al. | |
| 6,394,185 | B1 | 5/2002 | Constien | |
| 6,513,588 | B1 | 2/2003 | Metcalfe | |
| 6,543,545 | B1 | 4/2003 | Chatterji et al. | |
| 6,581,683 | B2 | 6/2003 | Ohanesian | |
| 6,769,484 | B2 | 4/2004 | Longmore | |
| 6,766,862 | B2 | 7/2004 | Chatterji et al. | |
| 6,831,044 | B2 | 12/2004 | Constien | |
| 7,048,048 | B2 | 5/2006 | Nguyen et al. | |
| 7,451,815 | B2 | 11/2008 | Hailey, Jr. | |
| 7,552,770 | B2 | 6/2009 | Braden | |
| 7,784,543 | B2 | 8/2010 | Johnson | |
| 7,942,206 | B2 | 5/2011 | Huang et al. | |
| 8,215,385 | B2 | 7/2012 | Cooke, Jr. | |
| 8,490,690 | B2 | 7/2013 | Lopez | |
| 2004/0231845 | A1 | 11/2004 | Cooke, Jr. | |
| 2005/0056425 | A1 | 3/2005 | Grigsby et al. | |
| 2006/0185849 | A1 | 8/2006 | Edwards et al. | |
| 2006/0272814 | A1 | 12/2006 | Broome et al. | |
| 2007/0007005 | A1* | 1/2007 | Heller | E21B 47/00 166/250.01 |
| 2007/0012444 | A1 | 1/2007 | Horgan et al. | |
| 2007/0190880 | A1* | 8/2007 | Dubrow | B01D 39/08 442/181 |
| 2008/0142222 | A1 | 6/2008 | Howard et al. | |
| 2008/0156481 | A1* | 7/2008 | Paulus Maria Heijnen | E21B 34/14 166/234 |
| 2010/0012323 | A1 | 1/2010 | Holmes et al. | |
| 2010/0258301 | A1 | 10/2010 | Bonner et al. | |
| 2011/0067872 | A1* | 3/2011 | Agrawal | E21B 43/082 166/302 |
| 2011/0162837 | A1 | 7/2011 | O'Malley et al. | |
| 2011/0253375 | A1 | 10/2011 | Jamaluddin et al. | |
| 2012/0067587 | A1 | 3/2012 | Agrawal et al. | |
| 2012/0131821 | A1* | 5/2012 | Brufau Guinovart | B22D 19/06 37/452 |
| 2012/0145389 | A1 | 6/2012 | Fitzpatrick, Jr. | |
| 2012/0186819 | A1 | 7/2012 | Dagenais et al. | |
| 2013/0048903 | A1* | 2/2013 | Garnier | B01J 27/22 252/71 |
| 2013/0118247 | A1* | 5/2013 | Akbari | F04C 2/1075 73/150 A |
| 2013/0199798 | A1 | 8/2013 | Seth et al. | |
| 2013/0206393 | A1 | 8/2013 | Kuo et al. | |

OTHER PUBLICATIONS

International Search report with Written Opinion dated Nov. 20, 2012 for PCT Patent Application No. PCT/US12/030182, 12 pages.
Office Action dated Apr. 24, 2013 for U.S. Appl. No. 13/720,339, 16 pages.
Office Action dated Jun. 17, 2013 for U.S. Appl. No. 13/765,395, 31 pages.
Office Action dated Nov. 18, 2013 for U.S. Appl. No. 13/720,339, 16 pages.
Office Action dated Nov. 29, 2013 for U.S. Appl. No. 13/765,395, 14 pages.
Office Action dated Feb. 11, 2014 for U.S. Appl. No. 13/765,395, 21 pages.
Office Action dated Feb. 24, 2014 for U.S. Appl. No. 13/720,339, 12 pages.
Office Action dated May 29, 2014 for U.S. Appl. No. 13/720,339, 13 pages.
Office Action dated Jun. 6, 2014 for U.S. Appl. No. 13/765,395, 14 pages.
Andy Limmack; "Thermal Conduction of Nano-Diamond Dispersed Polyurethane Nano-Composites", research paper, 9 pages.
A. H. Ei-Hag, et al.; "Erosion Resistance of Nano-filled Silicone Rubber", manuscript for the University of Waterloo, dated Apr. 25, 2005, 7 pages.
Karen Boman; "O&G Companies Pushing E&P Limits with Nanotechnology", Rig Zone article, dated Nov. 14, 2011, 2 pages.
Office Action, dated Mar. 24, 2017 issued for corresponding Canadian Patent Application No. 2,860,337.
Examination Report dated May 10, 2017 issued in corresponding European Patent Application No. 12872168.5.

* cited by examiner

NANO-PARTICLE REINFORCED WELL SCREEN

CROSS-REFERENCE TO RELATED APPLICATION

This application is a national stage under 35 USC 371 of International Application No. PCT/US12/30182, filed on 22 Mar. 2012. The entire disclosure of this prior application is incorporated herein by this reference.

TECHNICAL FIELD

This disclosure relates generally to equipment utilized and operations performed in conjunction with a subterranean well and, in one example described below, more particularly provides a well screen with a nano-particle reinforced filter.

BACKGROUND

Well screens are used to filter fluid produced from earth formations. Well screens remove sand, fines, debris, etc., from the fluid. It will be appreciated that improvements are continually needed in the art of constructing well screens.

SUMMARY

In this disclosure, improved well screens and methods of constructing well screens are provided to the art. One example is described below in which a porous substrate of a well screen filter is reinforced with nano-particles.

An improved well screen is provided to the art by the disclosure below. In one example, the well screen can include a filter with a nano-particle reinforcement.

A method of constructing a well screen is also described below. In one example, the method can include treating a filter with a nano-particle reinforcement.

The filter may comprise a porous substrate. The porous substrate can comprise a ceramic material. The nano-particle reinforcement may be disposed in pores of the ceramic material.

The nano-particle reinforcement can comprise nano-fibers, or other types of nano-particles. The nano-particle reinforcement may increase a tensile strength of the filter, reduce a brittleness of the filter, and/or increase an erosion resistance of the filter.

In some examples, the filter may comprise a ceramic material which filters fluid which flows between an annulus external to the well screen and an interior flow passage of the well screen.

In some examples, the filter may comprise a porous substrate positioned radially between a base pipe and a protective shroud.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
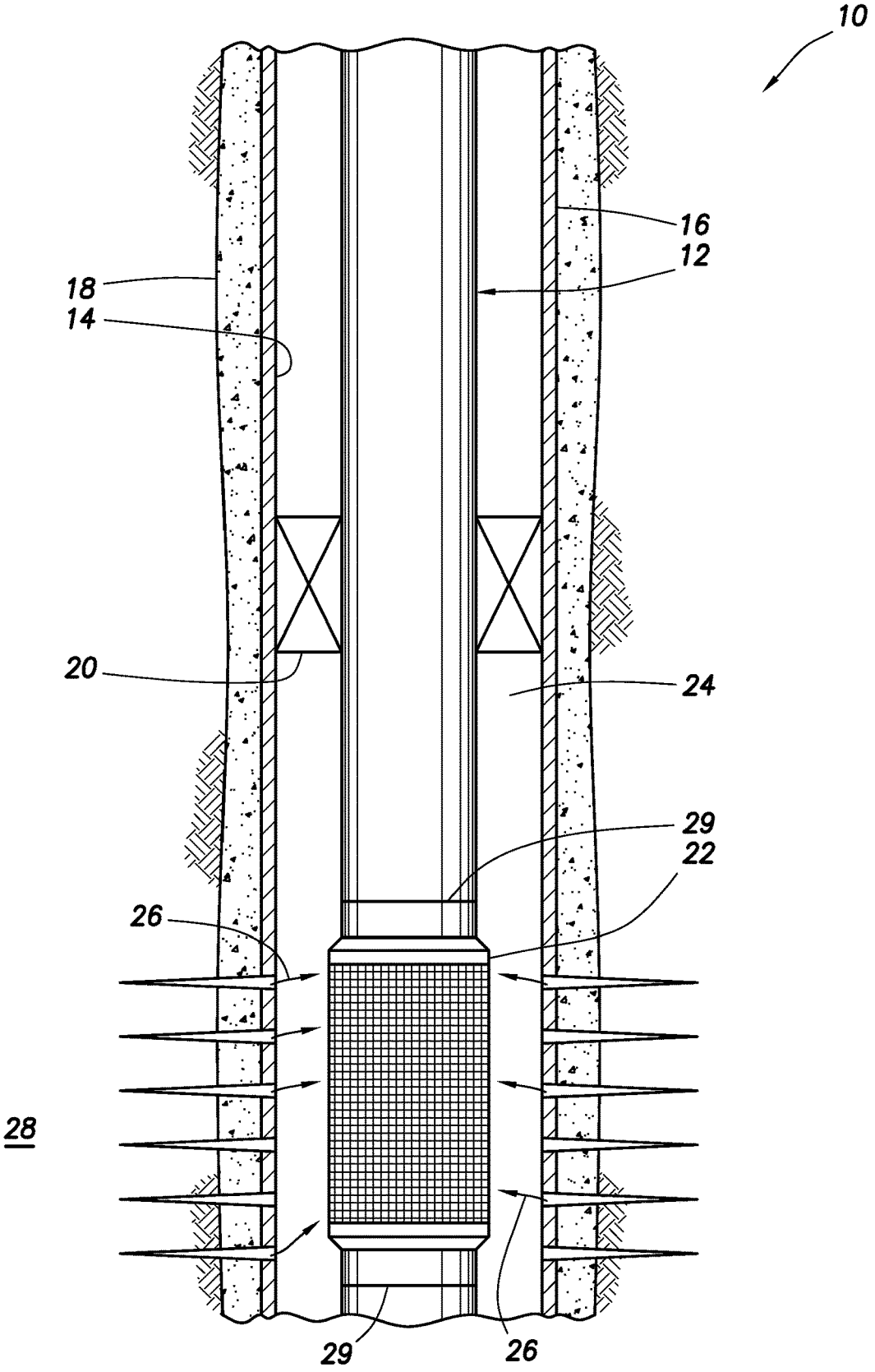
FIG. 1 is a representative partially cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIG. 1, a tubular string 12 (such as a production tubing string, a testing work string, a completion string, a gravel packing and/or stimulation string, etc.) is installed in a wellbore 14 lined with casing 16 and cement 18. The tubular string 12 in this example includes a packer 20 and a well screen 22.

The packer 20 isolates a portion of an annulus 24 formed radially between the tubular string 12 and the wellbore 14. The well screen 22 filters fluid 26 which flows into the tubular string 12 from the annulus 24 (and from an earth formation 28 into the annulus). The well screen 22 in this example includes end connections 29 (such as internally or externally formed threads, seals, etc.) for interconnecting the well screen in the tubular string 12.

The tubular string 12 may be continuous or segmented, and made of metal and/or nonmetal material. The tubular string 12 does not necessarily include the packer 20 or any other particular item(s) of equipment. Indeed, the tubular string 12 is not even necessary in keeping with the principles of this disclosure.

It also is not necessary for the wellbore 14 to be vertical as depicted in FIG. 1, for the wellbore to be lined with casing 14 or cement 18, for the packer 20 to be used, for the fluid 26 to flow from the formation 28 into the tubular string 12, etc. Therefore, it will be appreciated that the details of the system 10 and method do not limit the scope of this disclosure in any way.

Examples of the well screen 22 are described in more detail below. Each of the examples described below can be constructed conveniently, rapidly and economically, thereby improving a cost efficiency of the well system 10 and method, while effectively filtering the fluid 26.

Figure 2:
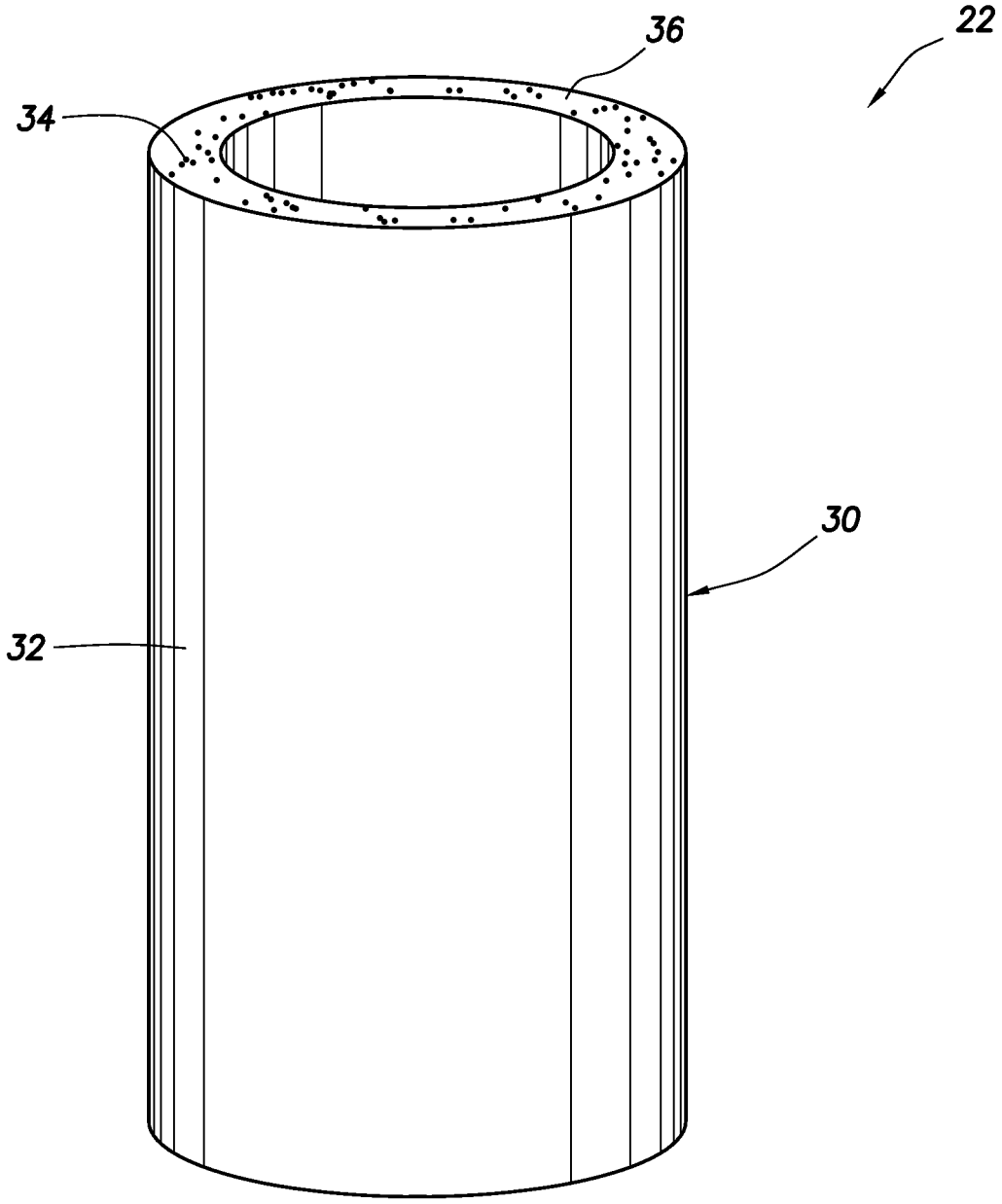
FIG. 2 is a representative oblique view of a filter for a well screen which may be used in the system and method of FIG. 1, and which can embody principles of this disclosure.

Referring additionally now to FIG. 2, a generally tubular filter 30 of the well screen 22 is representatively illustrated. Although the filter 30 is depicted in FIG. 2 as having an annular shape, and being a single element, any shape or number of elements may be used in the filter. For example, the filter could be sectioned radially and/or longitudinally, the filter could be flat or made up of flat elements, etc.

In the FIG. 2 example, the filter 30 comprises a porous substrate 32 reinforced with a nano-particle reinforcement 34. In one preferred construction, the porous substrate 32 can comprise a ceramic material 36. The nano-particle reinforcement 34 in this example can be dispersed into pores of the ceramic material 36.

As a result of treating the filter 30 with the nano-particle reinforcement 34, the filter can obtain increased strength, reduced brittleness, and/or reduced erosion due to flow of the fluid 26 through the filter. The reduced brittleness can be especially beneficial if the filter 30 comprises the ceramic material 36, or any relatively brittle material.

Suitable ceramic materials for use in the filter 30 include silicon carbide, alumina and mullite. Other materials and non-ceramic materials may be used, if desired.

Suitable nano-particle reinforcement 34 materials include titanium nitride, chromium nitride, silica, diamond, aluminum oxide, titanium oxide, etc. Suitable types of nano-particles include carbon nano-tubes and nano-graphites, nano-clusters, nano-powders, etc.

A nano-particle is generally understood to have at least one dimension from 100 to 1 nanometers. As used herein, the term nano-particle reinforcement refers to a reinforcement comprising particles having at least one dimension which is from about 1 nanometer to about 100 nanometers.

Figure 3:
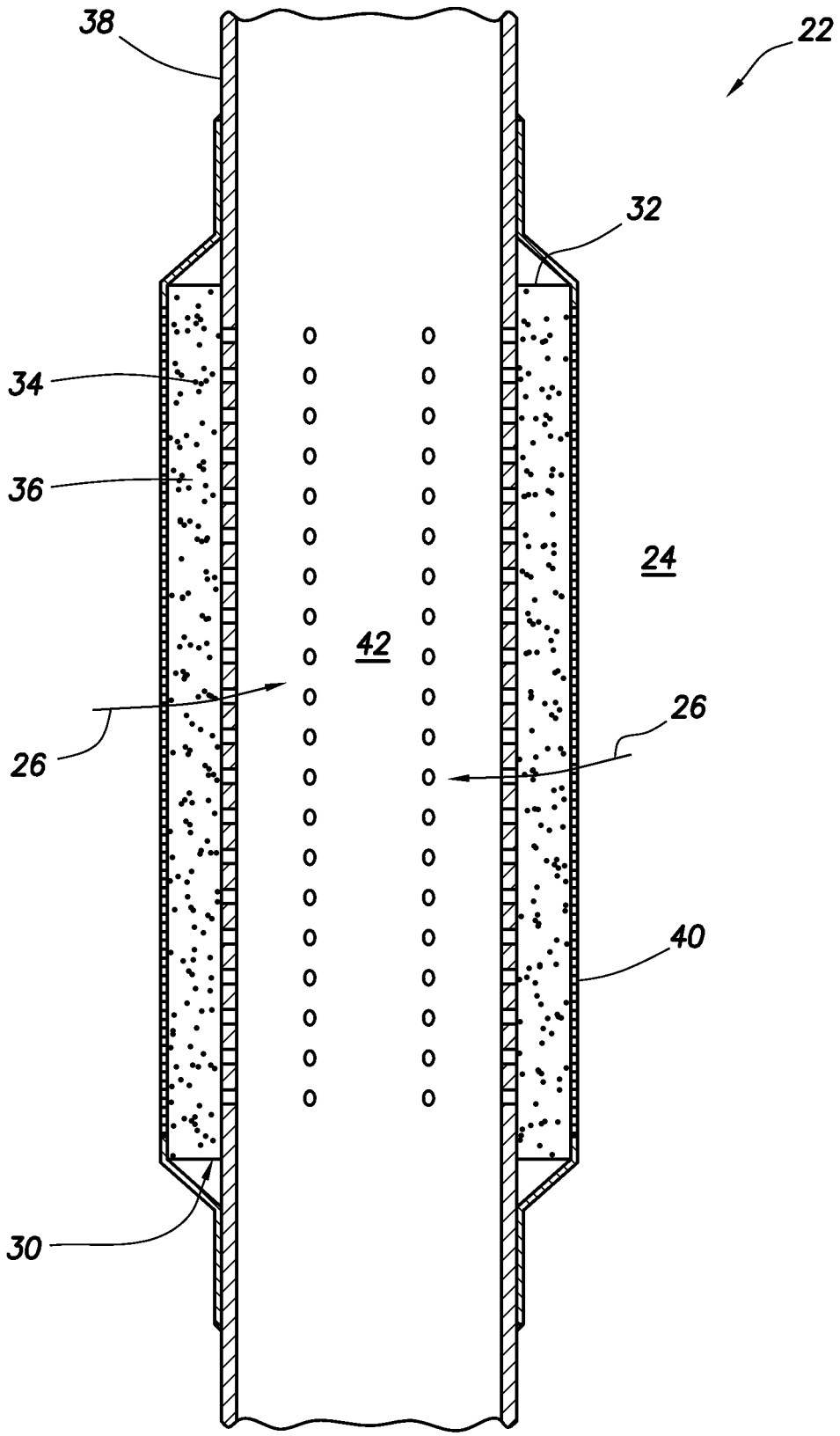
FIG. 3 is a representative cross-sectional view of the well screen.

Referring additionally now to FIG. 3, a cross-sectional view of one example of the well screen 22 is representatively illustrated. In this example, the filter 30 is positioned radially between a base pipe 38 and a protective shroud 40.

The base pipe 38 can have the end connections 29 for connecting the well screen 22 in the tubular string 12 in the system 10 of FIG. 1. A longitudinal flow passage 42 of the tubular string 12 can extend through the base pipe 38. Of course, the well screen 22 could be used in other systems and methods, in keeping with the scope of this disclosure.

The filter 30 is depicted in FIG. 3 as being external to the base pipe 38, but in other examples the filter 30 could be otherwise positioned relative to the base pipe (such as, internal to the base pipe, etc.).

In some examples, the substrate 32 can be separately formed (e.g., by casting, molding, etc.), and then positioned on or in, etc. the base pipe 38. In other examples, the substrate 32 could be formed on or in the base pipe 38 (e.g., by casting or molding the substrate on or in the base pipe, etc.).

Any manner of positioning the substrate 32 relative to the base pipe 38 may be used, in keeping with the scope of this disclosure. The substrate 32 may be treated with the nano-particle reinforcement 34 prior to, during or after the substrate is positioned relative to the base pipe 38.

The substrate 32 may be treated with the nano-particle reinforcement 34 by spraying or coating the substrate with nano-particles, molding or casting the substrate with the nano-particles, applying the nano-particles to the substrate, mixing the nano-particles with the substrate, etc. Any manner of incorporating the nano-particle reinforcement 34 into the filter 30 may be used, in keeping with the scope of this disclosure.

In one example, the filter 30 can be produced by treating a ceramic substrate 32 with a nano-particle reinforcement 34. For example, carbon nano-tubes or nano-graphites could increase the tensile strength of the filter 30, increase the filter's erosion resistance, and reduce the ceramic substrate's brittleness.

The shroud 40 is depicted in FIG. 3 as outwardly enclosing the filter 30. In this manner, the shroud 40 can protect the filter 30 during installation of the tubular string 12 in the wellbore 14. However, if the filter 30 is otherwise positioned (e.g., not external to the base pipe 38), then the shroud 40 could be otherwise positioned (e.g., internal to the base pipe 38), or not used at all.

In the FIG. 3 example, the shroud 40 is perforated to allow flow of the fluid 26 from the annulus 24 to the filter 30. The shroud 40 can be secured to the base pipe 38 by crimping and/or welding, or by any other technique.

Other elements (such as, a drainage layer, an additional filter layer, etc.) could be included in the well screen 22, if desired. The scope of this disclosure is not limited at all to the number, arrangement or types of elements in the FIG. 3 example of the well screen 22.

It may now be fully appreciated that the above disclosure provides significant advancements to the art of constructing screens for use in wells. In examples described above, a nano-particle reinforcement 34 is used to increase strength, decrease erosion and reduce brittleness of a filter 30 in a well screen 22. These benefits are achieved economically, conveniently and readily.

A well screen 22 is described above. In one example, the well screen 22 can comprise a filter 30 with a nano-particle reinforcement 34.

The filter 30 may include a porous substrate 32. The porous substrate 32 can comprise a ceramic material 36. The nano-particle reinforcement 34 may be disposed in pores of the ceramic material 36.

The nano-particle reinforcement 34 can comprise nano-fibers. Other types of nano-particles can be used, if desired. The nano-particle reinforcement 34 may increase a tensile strength, reduce a brittleness, and/or increase an erosion resistance of the filter 30.

The filter 30 can comprise a ceramic material 36 which filters fluid 26 which flows between an annulus 24 external to the well screen 22 and an interior flow passage 42 of the well screen 22. The filter 30 can comprise a porous substrate 32 positioned radially between a base pipe 38 and a protective shroud 40.

A method of constructing a well screen 22 is also described above. In one example, the method can include treating a filter 30 with a nano-particle reinforcement 34.

The treating step can comprise applying the nano-particle reinforcement 34 to a porous substrate 32. The porous substrate 32 may comprise a ceramic material 36.

The treating step can comprise dispersing the nano-particle reinforcement 34 into pores of a ceramic material 36.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well screen, comprising: a filter with a nano-particle reinforcement, wherein the filter comprises a permeable porous substrate, wherein the permeable porous substrate comprises a ceramic material, wherein the nano-particle reinforcement is disposed in pores of the ceramic material, wherein the ceramic material is mullite and is cast or molded directly onto a base pipe and is in abutment with the outer diameter surface of the base pipe along an entire axial length of the permeable porous substrate.

2. The well screen of claim 1, wherein the nano-particle reinforcement comprises nano-fibers.

3. The well screen of claim 1, wherein the nano-particle reinforcement increases a tensile strength of the filter.

4. The well screen of claim 1, wherein the nano-particle reinforcement reduces a brittleness of the filter.

5. The well screen of claim 1, wherein the nano-particle reinforcement increases an erosion resistance of the filter.

6. The well screen of claim 1, wherein the ceramic material filters fluid which flows between an annulus external to the well screen and an interior flow passage of the well screen.

7. The well screen of claim 1, wherein the permeable porous substrate is positioned radially between a base pipe and a protective shroud.

8. The well screen of claim 1, wherein the nano-particle reinforcement material is at least one of titanium nitride, chromium nitride, silica, diamond, aluminum oxide, or titanium oxide.

9. A method of constructing a well screen, the method comprising:

treating a filter of the well screen with a nano-particle reinforcement, wherein the filter comprises a permeable porous substrate, wherein the treating comprises applying the nano-particle reinforcement to the permeable porous substrate, and wherein the permeable porous substrate comprises a ceramic material, wherein the treating comprises mixing the nano-particle reinforcement with the ceramic substrate and casting or molding it directly onto a base pipe so that it is in abutment with an outer diameter surface of the base pipe along an entire axial length of the permeable porous substrate and the nano-particle reinforcement is dispersed into pores of the ceramic material, and wherein the ceramic material is mullite.

10. The method of claim 9, wherein the nano-particle reinforcement comprises nano-fibers.

11. The method of claim 9, further comprising the nano-particle reinforcement increasing a tensile strength of the filter.

12. The method of claim 9, further comprising the nano-particle reinforcement reducing a brittleness of the filter.

13. The method of claim 9, further comprising the nano-particle reinforcement increasing an erosion resistance of the filter.

14. The method of claim 9, wherein the ceramic material filters fluid which flows between an annulus external to the well screen and an interior flow passage of the well screen.

15. The method of claim 9, further comprising positioning the permeable porous substrate of the filter radially between a base pipe and a protective shroud.

16. The method of claim 9, wherein dispersing the nano-particle reinforcement into pores of the ceramic material comprises at least one of molding or casting the substrate with the nano-particles.

17. The method of claim 9, wherein the nano-particle reinforcement material is at least one of titanium nitride, chromium nitride, silica, aluminum oxide, or titanium oxide.

* * * * *